United States Patent [19]

Longeray et al.

[11] Patent Number: 4,705,815

[45] Date of Patent: Nov. 10, 1987

[54] ANTIREVERSE RUNNING-SURFACE TREATMENT FOR CROSS-COUNTRY SKIS

[75] Inventors: Rémi Longeray, Grigny; Pierre Lanteri, Villeurbanne; Thomas Mathia, Marcy L'Etoile; Francois Jodelet, Voiron; Serge Segura, Lyons, all of France

[73] Assignee: Skis Rossignol SA, Voiron, France

[21] Appl. No.: 907,070

[22] Filed: Sep. 12, 1986

[30] Foreign Application Priority Data

Sep. 30, 1985 [FR] France ..... 85 14974

[51] Int. Cl.[4] ..... C08G 18/14

[52] U.S. Cl. ..... 521/160; 521/172; 521/905; 528/67; 528/74.5; 280/604; 280/610

[58] Field of Search ..... 521/160, 172, 905; 528/67, 74.5; 280/604, 610

[56] References Cited

U.S. PATENT DOCUMENTS 4,595,215 6/1986 Tiitola ..... 280/610

*Primary Examiner*—Maurice J. Welsh

*Attorney, Agent, or Firm*—Karl F. Ross; Herbert Dubno

[57] ABSTRACT

An antibackslide treatment for a cross-country ski consists of a polyurethane containing a filler or closed-pore structure and which combined hydrophobicity with an elastic character which varies depending upon the velocity of its deformation. During the propulsion phase where the velocity of deformation is low, the treatment has viscoelastic characteristics whereas during the sliding phase when the velocity of deformation is high, the treatment has more elastic properties.

20 Claims, 3 Drawing Figures

ANTIREVERSE RUNNING-SURFACE TREATMENT FOR CROSS-COUNTRY SKIS

FIELD OF THE INVENTION

Figure 3:
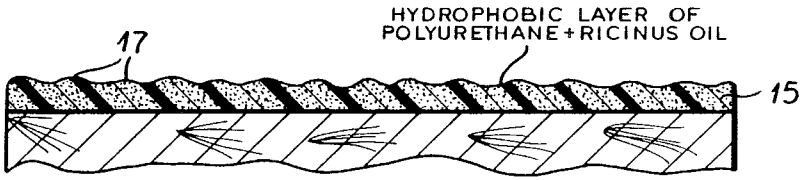
Figure 1:
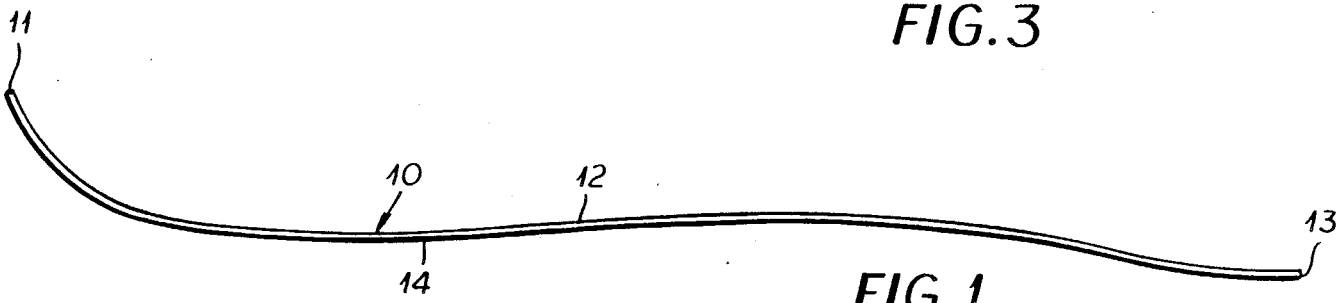
Figure 2:
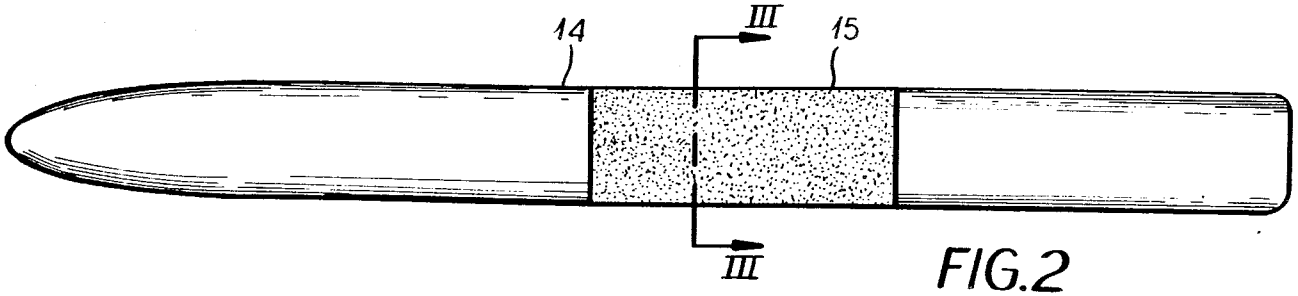

Our present invention relates to a polyvalent antireturn sole or surface treatment for a cross-country ski and, particularly, for the zone or zones of the running surface which are to have an antirecoil or reverse-motion blocking characteristic.

BACKGROUND OF THE INVENTION

It is known that there are a number of problems which are posed by attempts to provide an antirecoil or antireverse treatment on the running surface or bottom of a cross-country ski. This treatment should allow the bottom or running surface of the ski to have good sliding properties when the ski is slid forwardly on the snow, should not permit adhesion of snow to the underside of the ski, and should provide an antireverse characteristic whereby a reverse slipping of the ski is precluded or severely restricted. The term "reverse slip" and terms of similar import, such as "antirecoil" and "antibackslip" may be used from time to time herein to refer to a restriction on the backward movement of the ski caused by the character of the sole or running surface or parts thereof.

It has long been known that one can solve the problem of providing a resistance to reverse movement by the use of specific waxes selected in accordance with the characteristics of the snow over which the ski is to travel and requiring frequent renewal because of rapid wear of the wax surfaces. It is also known to provide the running surface of a ski with various formations such as ridges, fish-scale patterns or the like which frequently are only partially successful and which, in addition, are found to be noisy.

Certain other running surfaces of such skis for certain snow conditions require the local application of the antiadhesive products which it is necessary to renew from time to time and are designed to reduce the adhesion of snow to the running surface.

We have now found, after considerable research, that it is possible to provide an antirecoil sole or running surface for a cross-country ski which eliminates all of the problems enumerated above without requiring the sporadic application of specific products and which presents a polyvalence in the sense that it is applicable to all snow qualities and characteristics.

It is known, that the cross-country ski cycle in the classic advancing maneuver can be broken down essentially into three phases corresponding to the different interactions of the running surface of the ski and the snow. In the impulse or propulsion phase, the skier presses the ski against the snow in order to propel himself forwardly. In an intermediate phase or lightening phase, there is a sharp relief of pressure on the snow. This is generally followed in the last phase by a sliding of the ski along the snow.

We have studied the sliding mechanism and the interaction of the running surface and the ski on the snow and discovered that it is conditioned essentially by the polyphasic nature of the snow and that there are three factors involved in the participation of the snow in the mechanism of this interaction, namely, the hydrophobic character of the running surface with respect to the snow, the rheological characteristics of the surface of the underside of the ski and the topography of the surface of the sole of the ski.

The hydrophobicity of the running surface of the ski appears to be particularly important in the pressure reduction or lightening phase and during sliding. In the lightening phase, the hydrophobicity precludes adhesion of the snow which might otherwise tend to cause a phenomenon of balling-up of snow on the ski or of icing-up. By contrast, the hydrophobicity favors sliding whatever the nature of the snow and the mechanism causing it.

The mechanism of the rheological character is essentially the following:

(a) During sliding the contact with each grain of snow is sufficiently short so that the material of the sole or the treatment of the running surface is essentially elastic. The material is deformed only slightly and remains smooth and slidable.

(b) During the impulse generating or propulsion phase, when considerable pressure is applied by the skier against the snow, the contact with each grain of snow is sufficiently long for the material to have an essentially viscous character. The grains of snow can thus penetrate into the material and provide a resistance to reverse movement enabling the skier to push-off against the snow.

(c) When this interaction ceases, the material, thanks to its elastic memory, recovers its original shape and the ski is thus ready for its next cycle or step (propulsion phase).

These studies have shown that there is a difference in the tribological characteristics of the running surface of the ski in its propulsion and sliding phases. In the propulsion phase the treatment of the underside of the ski acts to resist reverse movement and the contact with this surface by the snow is an action of compression whereas during the sliding phase the contact with this layer involves a shearing action.

The propulsion phase is clearly much shorter than the sliding phase, i.e. of a duration of 0.1 to 0.2 seconds compared to 0.5 to 1.5 seconds.

We have found, considering the requirement for polyvalence, i.e. effective action on different types of snow, the thickness of the surface layer of the underside of the ski and the granulometry of the different type of snow, that the speed of deformation of the running surface during the brief propulsion period can vary between 0.1 and 10 sec. $^{-1}$ while, during the sliding phase, when the tangential velocity is of the order of 1 to 10 m/sec., the running surface is essentially subject to shear action and the velocity of the deformation is between 1 and 100 sec. $^{-1}$, the velocity, of course, being in terms of an appropriate distance measure and being given without this means for the sake of comparison only. In order, therefore, to increase the anchorage phenomenon whereby the ski retards reverse movement during the propulsion phase, it is necessary to reduce the elasticity on compression while ensuring that the elasticity to shear will remain high during the sliding phase.

OBJECTS OF THE INVENTION

It is, therefore, the principal object of the present invention to provide an improved sole or running surface treatment for a cross-country ski which utilizes the results of the aforedescribed research and provides for improved antirecoil or antireverse displacement of the ski, especially during the propulsion phase.

Another object of the invention is to provide an improved cross-country ski which is free from the drawbacks of earlier systems described above.

Still another object of the invention is to provide a method of improving the antireverse movement characteristics or antibackslide characteristics of the running surface of a cross-country ski.

SUMMARY OF THE INVENTION

These objects and others which will become more readily apparent hereinafter are attained in accordance with the invention, which provides a treatment for the running surface of a cross-country ski having improved hydrophobicity good resistance to abrasion with elastic properties which are highly sensitive to the velocity of its deformation during the propulsion phase and a character which permits the introduction of a plurality of snow crystals into the surface treatment during this propulsion phase while, during the gliding and sliding phase, the composition presents an increased elasticity permitting rapid disengagement of the snow crystals regardless of the temperature or nature of these crystals, the surface treatment having a topography which is characterized by a distribution of profiles or crests of different heights compatible with the granulometry of the different types of snow which the ski may encounter.

We have found, surprisingly, that while there are numerous elastomers which may have several of the properties outlined above as essential for an effective antibackslide coating for the running surface for a cross-country ski, there are certain polyurethanes which possess all of the characteristics and are thus highly preferred as the materials which are used in accordance with the invention. The polyurethanes are obtained by the polycondensation of the diisocyanate with a polyol having a hydrocarbon character with 8 to 20 carbon atoms between hydrophilic functional groups.

The diisocyanate can be selected from the group which consists of diphenylmethane 4-4'-diisocyanate (MDI), toluene diisocyanate (TDI), hexamethylene diisocyanate (HDI) and mixtures thereof.

Advantageously, the diisocyanate or diisocyanates used in the polycondensation are in stoichiometric excess over that required to react with polyol or polyols. Preferably, the diisocyanate used is in 10 percent to 30 percent excess over that which is stoichiometrically required to react with the polyol.

$$\begin{array}{l} CH_3-(CH_2)_5-CHOH-CH_2-CH=CH-(CH_2)_7-CO_2CH_2 \\ \qquad\qquad\qquad\ while, for low deformation velocities in compression, the modulus of elasticity is found to lie between $5.10^6$ and $10^8$ Newtons/$m^2$. The surface treatment thus has the viscoelastic properties corresponding to the criteria set forth above, namely, a viscous deformation during the propulsion phase or for static deformation and increased elasticity during the dynamic deformation phase, i.e. on sliding.

We claim:

1. An antibackslide coating for a running surface of a cross-country ski, comprising a hydrophobic composition with abrasion resistance and viscoelastic properties such that the composition is highly sensitive to the velocity of its deformation and the direction of attack of snow engaged by said coating so that, during a propulsion phase of cross-country ski action, the coating permits some penetration of snow crystals into the coating while, during a gliding phase, the coating has enhanced elasticity ensuring rapid disengagement of such crystals whatever the temperature and nature of these crystals, said coating having a topography defined by crests of different heights and a crest-height distribution compatible with the granulometry of a variety of different types of snow.

2. The antibackslide coating defined in claim 1 wherein said composition is a polyurethane formed by the polycondensation of a diisocyanate with a polyol having hydrocarbon chains with 8 to 20 carbon atoms between hydrophilic functional groups.

3. The antibackslide coating defined in claim 2 wherein the diisocyanate is selected from the group which consists of diphenylmethane-4,4'-diisocyanate, toluene-diisocyanate, hexamethylene-diisocanate, and mixtures thereof.

4. The antibackslide coating defined in claim 2 wherein the diisocyanate used in the polycondensation is in stoichiometric excess over that required to react with said polyol.

5. The antibackslide coating defined in claim 4 wherein the diisocyanate used in the polycondensation is in 10 to 30% excess over that stoichiometrically required to react with said polyol.

6. The antibackslide coating defined in claim 2 wherein said polyol is ricinus oil.

7. The antibackslide coating defined in claim 2 wherein said composition contains a filler selected from the group which consists of synthetic-resin fibers and mineral particles.

8. The antibackslide coating defined in claim 2 wherein said coating has a porous closed-pore structure.

9. The antibackslide coating defined in claim 2 wherein the composition constitutes the sole antibackslide coating on the ski.

10. The antibackslide coating defined in claim 2 wherein said composition is combined with at least one other antibackslide composition on said ski.

11. A cross-country ski comprising an elongated ski body formed with a running surface and an antibackslide coating on at least a portion of said running surface, said antibackslide coating comprising a hydrophobic composition with abrasion resistance and viscoelastic properties such that the composition is highly sensitive to the velocity of its deformation and the direction of attack of snow engaged by said coating so that, during a propulsion phase of cross-country ski action, the coating permits some penetration of snow crystals into the coating while, during a gliding phase, the coating has enhanced elasticity ensuring rapid disengagement of such crystals whatever the temperature and nature of these crystals, said coating having a topography defined by crests of different heights and a crest-height distribution compatible with the granulometry of a variety of different types of snow.

12. The ski defined in claim 11 wherein said composition is a polyurethane formed by the polycondensation of a diisocyanate with a polyol having hydrocarbon chain with 8 to 20 carbon atoms between hydrophilic functional groups.

13. The ski defined in claim 12 wherein the diisocyanate is selected from the group which consists of diphenylmethane-4,4'-diisocyanate, toluene-diisocyanate, hexamethylene-diisocyanate, and mixtures thereof.

14. The ski defined in claim 12 wherein the diisocyanate used in the polycondensation is in stoichiometric excess over that required to react with said polyol.

15. The ski defined in claim 14 wherein the diisocyanate used in the polycondensation is in 10 to 30% excess over that stoichiometrically required to react with said polyol.

16. The ski defined in claim 12 wherein said polyol is ricinus oil.

17. The ski defined in claim 12 wherein said composition contains a filler selected from the group which consists of synthetic-resin fibers and mineral particles.

18. The ski defined in claim 12 wherein said coating has a porous closed-pore structure.

19. A method of controlling backsliding properties of a cross-country ski which comprises applying to a running surface of said ski a hydrophobic composition with abrasion resistance and viscoelastic properties such that the composition is highly sensitive to the velocity of its deformation and the direction of attack of snow engaged by said coating so that, during a propulsion phase of cross-country ski action, the coating permits some penetration of snow crystals into the coating while, during a gliding phase, the coating has enhanced elasticity ensuring rapid disengagement of such crystals whatever the temperature and nature of these crystals, said coating having a topography defined by crests of different heights and a crest-height distribution compatible with the granulometry of a variety of different types of snow.

20. The ski defined in claim 19 wherein said composition is a polyurethane formed by the polycondensation of a diisocyanate with a polyol having hydrocarbon chains with 8 to 20 carbon atoms between hydrophilic functional groups.

* * * * *